United States Patent [19]

Kolesar et al.

[11] Patent Number: 4,809,638

[45] Date of Patent: Mar. 7, 1989

[54] OCEAN LOCATION MARKING USING FILM FORMING POLYMERS

[75] Inventors: Robert R. Kolesar; J. Terry Richard, both of San Diego, Calif.

[73] Assignee: The United States of America as represented by the Secretary of the Navy, Washington, D.C.

[21] Appl. No.: 115,299

[22] Filed: Nov. 2, 1987

[51] Int. Cl.[4] ..... G01D 21/00

[52] U.S. Cl. ..... 116/26; 116/209

[58] Field of Search ..... 116/209, 211, 26, 207, 116/216, 219; 441/6, 11, 13, 20; 252/301.16, 301.19, 381, 408.1, 356, 357; 73/104, 105; 524/503, 803

[56] References Cited

U.S. PATENT DOCUMENTS

| | | | |
|---|---|---|---|
| 3,095,851 | 7/1963 | Lager | 116/211 |
| 3,297,585 | 1/1967 | Hayden | 116/211 |
| 3,676,359 | 7/1972 | Garrett et al. | 252/301.3 R |
| 3,745,566 | 7/1973 | Johnson | 343/5 |
| 3,783,284 | 1/1974 | McCormack | 250/339 |
| 3,859,680 | 1/1975 | Larsen | 116/211 |
| 3,899,213 | 8/1975 | Fantasia et al. | 250/301 |
| 4,160,033 | 7/1979 | Garrett et al. | 424/285 |
| 4,191,048 | 3/1980 | Molina | 73/104 |
| 4,250,140 | 2/1981 | Rowlette | 252/381 |
| 4,620,941 | 11/1986 | Yoshikawa et al. | 116/207 |

*Primary Examiner*—William A. Cuchlinski, Jr.
*Assistant Examiner*—Petar Arsenovic
*Attorney, Agent, or Firm*—Thomas Glenn Keough; Harvey Fendelman

[57] ABSTRACT

A method of and an apparatus for providing an all weather day and night location marker on the surface of a body of water enable optional visual, radar and IR detection to ensure the timely rescue of a disaster victim. A cohesive surfactant is mixed with an evaporation reducer and contained in a packet that allows the dispersing of a film made up of the two compounds after they are placed in the water. The film creates a surface that has a slick appearance with respect to the surrounding water, that has a reduced radar backscatter with respect to the surrounding water and which, as a result of reduced evaporative cooling, results in a local increase in the surface temperature with respect to the surrounding water to assure the visual, radar and IR detection.

32 Claims, 1 Drawing Sheet

OCEAN LOCATION MARKING USING FILM FORMING POLYMERS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Open ocean marking usually relies on some sort of a buoyant marker or flares or, in case of an emergency, radio frequency transmitters that are either buoyed to the surface or could be suspended from a balloon. Since weather conditions play an important part in the effectiveness of most of the passive location markers, they usually are of marginal effectiveness, unless search and rescue craft are first vectored into an area where a marine disaster is thought to have occurred. Furthermore, active markers such as radio transmitter's, blinking lights and the like can exhaust a self contained power source, may not operate properly when swamped by high seas states, and are not covert. Surface slicks have been used to calm surface waters and some have suggested the use of radar to detect these slicks. However, the effectiveness of radar to locate these slicks is questionable in dead calm weather conditions.

Thus, a continuing need exists in the state-of-the-art for a passive all weather location marker that is functional both day and night to enable an optional visual, radar and IR detection so that a subsequent recovery or rescue of disaster victims can occur.

SUMMARY OF THE INVENTION

The present invention is directed to providing a method of and an apparatus for providing an all weather, day and night location marker to enable visual, radar and IR detection. The method calls for providing a first and a second compound having the properties for forming a film on the water's surface. The first compound additionally has the property for reducing surface tension with respect to the surrounding water to eliminate capillary waves when dispersed on the water's surface. The second compound also has the property for reducing the evaporation rate with respect to the surrounding water when it is dispersed on the water's surface. Placing the compounds together in the body of water allows the dispersing of the film that contains the compounds on the water's surface. This creates a surface that has a slick appearance with respect to the surrounding water, that has a reduced radar backscatter with respect to the surrounding water, and that has a warmer surface temperature with respect to the surrounding water to enable visual, radar and IR detection. The first compound is a cohesive surfactant that is mixed with an evaporation retardant of the second compound Placing the compounds in a water permeable, water soluble or releasable container assures the disposing of the film on the water's surface.

The apparatus includes a means for providing reduced surface tension with respect to the surrounding water to eliminate capillary waves when it is dispersed on the water's surface. An evaporation reducing means is mixed in the reduced surface tension providing means to reduce the evaporation with respect to the surrounding water when it is dispersed on the water's surface.

The mixed reduced surface tension compound and the evaporation reducing compound are released by a releasing means into the body of water and disperse forming a film on the body of water. The film creates a surface that has a slick appearance with respect to the surrounding water, that has a reduced radar backscatter with respect to the surrounding water and that, as a result of reduced evaporation, has a warmer surface temperature with respect to the surrounding water to enable visual, radar and IR detection. The releasing means includes a packet sized to be carried in the proximity of the surface of the body of water, either on a vessel or on an individual wearer. The packet is fabricated to disperse the mixed compounds by being water permeable, water soluble or subject to releasing the compounds upon an occurrence of a predetermined event. Mixing a cohesive surfactant with an evaporation retardant assures the generation of a film that provide for the visual, radar and IR detection.

A prime object of the invention is to provide an improved location marker for disaster victims.

Another object is to provide a location marker capable of providing an all weather, day and night detection and timely location for subsequent rescue and salvage operations.

Yet another object is to provide a location marker being uncomplicated in design to assure the reliable creation of a location marker.

Still another object is to provide a location marker being detectable by visual, radar and IR means.

Yet another object to the invention is to provide an all weather, day and night location marker that is passive thereby lending itself to covert operations.

Still another object is to provide a location marker capable of providing a visual, radar and IR detection in any type of weather, day and night and not requiring ancillary power sources.

Still yet another object is to provide for a location marker that begins to be deployed as a disaster victim enters the water to produce an enlarging surface slick that provides for visual, radar and IR detection.

Still another object is to provide a location marker detectable by surface craft, aircraft and satellites.

Still yet another object is to provide for an ocean location marker that is deployed upon the occurrence of a predetermined condition such as sinking, excessive pressure, explosion, fire, remotely originating radio or sonar signals and the like.

These an other objects of the invention will become more readily apparent from the ensuring specification and drawings when taken in conjunction with the appended claims.

DESCRIPTION OF THE PREFERRED EMBODIMENT

Figure 1:
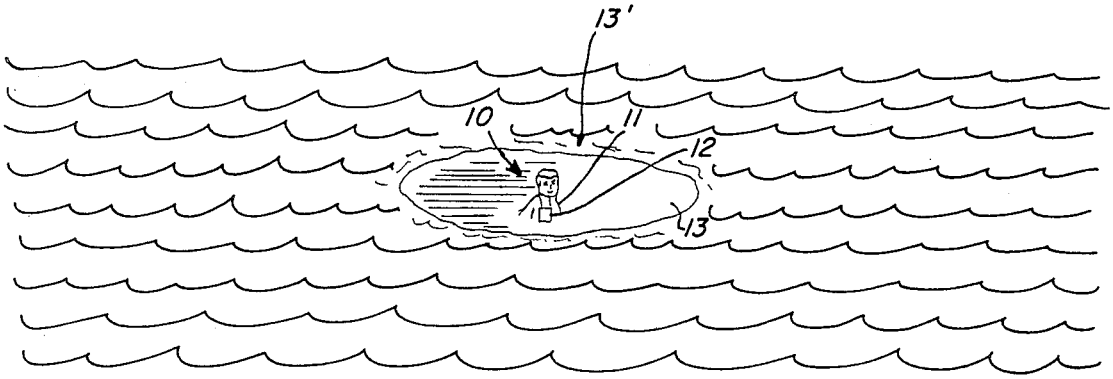
FIG. 1 depicts a disaster victim creating a location marker from the packet.

Looking now to FIG. 1 of the drawings a shipwrecked or air mishap survivor 10 is floating on the ocean's surface after an untimely disaster. Fortunately for this survivor, his clothing or floatation gear 11 is provided with a survival packet 12 of the type of this invention which assures a timely location and ultimate rescue. The packet also could be carried on a raft, ship or aircraft which finds itself in the water and its location should be marked for rescue, salvage or other reasons.

Survival packet 12 is designed to release compounds in a spreading film 13 that functions as a location marker 13'. The make up of the location marker is specifically chosen for appropriate monitors that enable a visual, radar and infrared "IR" detection.

Figure 2:
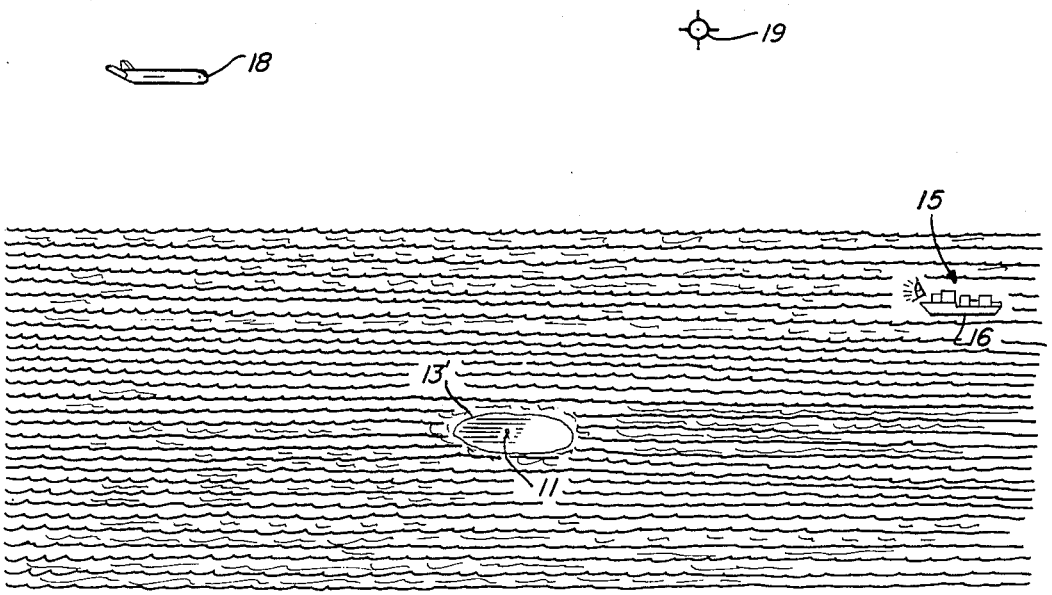
FIG. 2 is an isometric depiction of a surface marker being sensed by visual, radar and IR means.

Referring to FIG. 2 location marker 13' is schematically depicted in a sea state characterized by small surface waves and general surface agitation so that its slick appearance is detectable by visual means 15 on a surface craft 16 or on a aircraft 18, as well as a shore based or some other type of suitable visual observation platform (not shown). Location marker 13' also is formed by compounds that have the properties which enable its detection by a wide variety of radars that have a wavelength comparable with capillary waves producing an area of reduced radar backscatter. Typically, appropriate radars can be carried in surface craft 16 and aircraft 18. Some sophisticated satellites 19 might have radar units for providing a necessary detection resolution within their range of orbits.

A further distinguishing characteristic of this concept is that the compounds forming the location marker give the location marker the capability of being detectable by IR detection schemes currently in use and included on aircraft. Surface ship 16, aircraft 18 and satellite 19 provided with a suitable IR detector can sense the location markers at a considerable distance.

Survival packet 12 is fabricated to release a location marker film. The film is made up of a first compound and a second compound that are mixed together to enable a simultaneous visual, radar and IR detection during the day or night and not depended on the weather. Several packet designs can accommodate the compounds when they are mixed powders or liquids or when an outside condition is relied upon to disperse them in a slick.

Figure 3A:
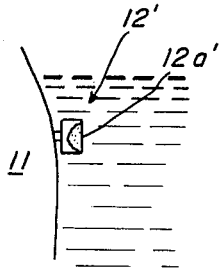
FIG. 3*a*, 3*b* and 3*c* depict water permeable, water soluble and releasable packet containers.

Looking to FIG. 3*a* survival packet 12' is a water permeable structure having at least one water permeable wall 12*a'*. The mixed compounds are leached or dissolved out of the packet by the water coming through the permeable walls. Film 13 spreads to define the extent of location marker 13'

Figure 3B:
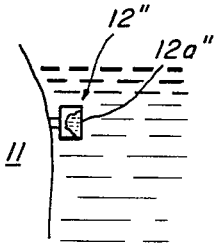

FIG. 3*b* depicts a survival packet 12" formed of a vial containing the first and second compounds. The vial has at least a water soluble portion 12*a"* so that after a predetermined period of time, the vial dissolves and the liquid compounds are released to produce the location marker film.

Figure 3C:
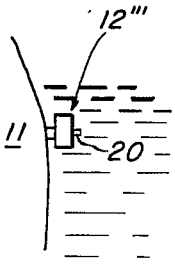

A third configuration such as shown in FIG. 3*c* has a survival packet 12''' with a rupturable wall 12*a'''*. An explosive charge, compressed spring or other suitable means for rupturing wall 12*a'''* or for otherwise opening the packet to the water is operably associated with a condition responsive module 20. Optionally, the module is an electronics packet responsive to a surrounding condition such as a remote acoustic or radio signal to initiate the rupture of the packet via an interconnected squib (not shown). In the alternative, the package is a condition responsive mechanism responsive, for example to fire, shock, pressure or the like to create an opening in the container and the dispersing of the compounds. Irrespective which means of actuation is selected the end effect is the same. When the container is opened to the surrounding water, the film is dispensed to provide a sufficient location marker for remote sensing by visual, radar and IR means.

The visual, radar and IR detection capabilities of the location marker film is due to the constituency of the mixed two compounds forming it. The two compounds are, first, a cohesive surfactant and, second, an evaporation retardant. Both are mixed together and function together to form the location marker film.

Cohesive surfactants have a specific gravity less than one. As used in this concept, their property of reducing surface tension in water is relied upon to diminish or eliminate capillary waves. Capillary waves are created mostly by waves and surface disturbance. An area covered by a film of a cohesive surfactant assures a visually observable slick as well as one having reduced radar backscattering. Typically, cohesive surfactant should have a molecular structure which contains both a hydrophilic group (absorptive at the water surface) and a hydrophobic group which orients away from the water's surface. The material must spread spontaneously into a water-insoluble monomolecular film so that only small quantities are required. The hydrocarbon portion of the molecule should contain at least 18 carbon atoms to minimize evaporation and dissolution of the surfactant. For use on saltwater a nonionic film-forming chemical is required to further reduce solubility. Commercially available materials which satisfy these requirements include fatty alcohols, glyceride esters of fatty acids and several synthetic surface-active agents (e.g. oleyl alcohol, isostearyl alcohol, oleyl ether, oleic acid cottonseed oil). This listing is not intended to be exhaustive. These typical examples have a capability for reducing surface tension so that the resulted slick is visually observable and has a reduced radar backscatter with respect to the surrounding water. Others may be selected by one skilled in the art.

An evaporation retardant is mixed with a cohesive an IR detection capability. The IR surfactant to assure detection capability comes about as a result of the area of reduced evaporation under the film that is created by the evaporation retardant. As a consequence, this area has a warmer surface temperature with respect to the surrounding water which is not coated with the film. Each evaporation retardant also is cohesive and is well mixed with a chosen cohesive surfactant so that their combined properties give the visual, radar and IR detection capabilities.

There are not many commercially available chemicals that act as evaporation retardant chemicals. The requirement is for a long straight molecular chain such that the molecules can be arranged to form a densely packed film. One such commercially available chemical which exhibits such characteristics is cetyl alcohol. Mixing the surfactant and the evaporation retardant, or combining them by other well known means, assures that the visual, radar and IR capabilities are consistent throughout the surface marker slick created on the water surface.

Four ounces of the mixed cohesive surfactant and evaporation retardant have produced a film an acre in size. This area is sufficient for a number of conventional radars and IR detection systems to locate this marker as well as being sufficient for a visual observer to see it.

Obviously, many modifications and variations of the present invention are possible in the light of the above teachings. It is therefore to be understood that within the scope of the appended claims the invention may be practiced otherwise than as specifically described.

We claim:

1. A method of providing an all weather, day and night location marker on the surface of a body of water to enable visual, radar and IR detection comprising:

providing a first and a second compound both having specific gravities less than one, the first compound having the property for reducing surface tension with the respect to the surrounding water to eliminate capillary waves when dispersed on the water's surface and the second compound having the property for reducing the evaporation rate with respect to the surrounding water when dispersed on the water's surface;

placing the compounds together in the body of water; and dispersing a film that contains the compounds on the water's surface to create a surface that has a slick appearance with respect to the surrounding water, that has a reduced radar backscatter with respect to the surrounding water and that has an elevated surface temperature with respect to the surrounding water to enable visual, radar and IR detection.

2. A method according to claim 1 in which the step of providing includes the mixing of the first and second compounds to assure that the dispersed film has both compounds therein.

3. A method according to claim 2 in which step of placing is the immersing of a water permeable structure containing the first and second compounds in the body of water to enable the dispersing.

4. A method according to claim 2 in which the step placing is the immersing of a water soluble vial containing the first and second compounds in the body of water to enable the dispersing.

5. A method according to claim 2 in which the step of placing includes the immersing of a container housing the first and second compounds that is preconditioned to release the compounds in accordance with a predetermined condition to enable the dispersing.

6. A method according to claims 1, 2, 3, 4 or 5 in which the first compound is a cohesive surfactant and the second compound is an evaporation retardant.

7. A method according to claim 6 in which the first compound is a fatty alcohol and the second compound is cetyl alcohol.

8. A method according to claim 6 in which the first compound is a glyceride ester of a fatty acid and the second compound is cetyl alcohol.

9. A method according to claim 6 in which the first compound is a synthetic surface-active agent such as oleyl alcohol and the second compound is cetyl alcohol.

10. A method according to claim 6 in which the first compound is a synthetic surface-active agent such as isostearyl alcohol and the second compound is cetyl alcohol.

11. A method according to claim 6 in which the first compound is a synthetic surface-active agent such as oleyl ether and the second compound is cetyl alcohol.

12. A method according to claim 6 in which the first compound is a synthetic surface-active agent such as oleic acid and the second compound is cetyl alcohol.

13. A method according to claim 6 in which the first compound is a synthetic surface-active agent such as cottonseed oil and the second compound is cetyl alcohol.

14. An apparatus for providing an all weather, day and night location marker on the surface of a body of water to enable visual, radar and IR detection comprising:

means for providing reduced surface tension with respect to the surrounding water to eliminate capillary waves when dispersed on the water's surface;

means mixed in the reduced surface tension providing means for reducing evaporation with respect to the surrounding water when dispersed on the water's surface; and means containing the mixed reduced surface tension providing means and the evaporation means reducing for releasing them in the body of water to be dispersed in a film including the mixed reduced surface wave tension providing means and the evaporation reducing means to create surface that has a slick appearance with respect to the surrounding water, that has a reduced radar backscatter with respect to the surrounding water and that has an elevated surface temperature with respect to the surrounding water to enable visual, radar and IR detection.

15. An apparatus according to claim 14 in which the releasing means includes a packet sized to be carried in the proximity of the surface of the body of water and fabricated tp disperse the reduced surface wave providing means and the evaporation reducing means.

16. An apparatus according to claim 15 in which the packet is fabricated to be water permeable.

17. An apparatus according to claim 15 in which the packet is fabricated to be water soluble.

18. An apparatus according to claim 15 in which the packet is fabricated to disperse upon the occurrence of a predetermined condition.

19. An apparatus according to claims 14, 15, 16, 17 or 18 in which the reduced surface tension providing means is the compound identified as a cohesive surfactant and the evaporation reducing means is the compound identified as an evaporation retardant.

20. An apparatus according to claim 19 in which the reduced surface wave tension providing means is a fatty acid and the evaporation reducing means is cetyl alcohol.

21. An apparatus according to claim 19 in which the reduced surface wave tension providing means is a glyceride ester of a fatty acid and the evaporation reducing means is cetyl alcohol.

22. An apparatus according to claim 19 in which the reduced surface wave tension providing means is a synthetic surface-active agent such as oleic acid and the evaporation reducing means is cetyl alcohol.

23. An apparatus according to claim 19 in which the reduced surface wave tension providing means is a synthetic surface-active agent such as cottonseed oil and the evaporation reducing means is cetyl alcohol.

24. An apparatus according to claim 19 in which the reduced surface wave tension providing means is a synthetic surface-active agent such as isostearyl alcohol and the evaporation reducing means is cetyl alcohol.

25. An apparatus according to claim 19 in which the reduced surface wave tension providing means is a synthetic surface-active agent such as oleyl ether and the evaporation reducing is cetyl alcohol.

26. A method of manufacturing an apparatus that provides an all weather, day and night location marker on the surface of a body of water that assures an optional visual, radar and IR detection thereof comprising:

providing a first and a second compound both having specific gravities less than one, the first compound having the property for reducing surface tension with respect to the surrounding water to eliminate capillary waves when dispersed on the water's surface and the second compound having the property for reducing the evaporation rate with respect to the surrounding water when dispersed on the water's surface;

placing the compounds together in the body of water; and dispersing a film that contains the compounds on the water's surface to create a surface that has a slick appearance with respect to the surrounding water, that has a reduced radar backscatter with respect to the surrounding water and that has an elevated surface temperature with respect to the surrounding water to enable visual, radar and IR detection.

27. A method of manufacturing an apparatus according to claim 26 in which the step of providing includes the mixing of the first and second compounds to assure that the dispersed film has both compounds therein.

28. A method of manufacturing an apparatus according to claim 27 in which step of placing in the immersing of a water permeable structure containing the first and second compounds in the body of water to enable the dispersing.

29. A method of manufacturing an apparatus according to claim 27 in which the step of placing in the immersing of a water soluble vial containing the first and second compounds in the body of water to enable the dispersing.

30. A method of manufacturing an apparatus according to claim 27 in which the step of placing includes the immersing of a container housing the first and second compounds that is preconditioned to release the compounds in accordance with a predetermine condition to enable the dispersing.

31. A method according to claims 26, 27, 28, 29, or 30 in which the first compound is a cohesive surfactant and the second compound is an evaporation retardant.

32. A method according to claim 31 in which the first compound is oleyl alcohol and the second compound is cetyl alcohol.

* * * * *

UNITED STATES PATENT AND TRADEMARK OFFICE

CERTIFICATE OF CORRECTION

PATENT NO. : 4,809,638

DATED : 7 March 1989

INVENTOR(S) : Robert R. Kolesar and J. Terry Rickard

It is certified that error appears in the above-identified patent and that said Letters Patent is hereby corrected as shown below:

Change the name of the co-inventor "J. Terry Richard" to -- J. Terry Rickard --.

Signed and Sealed this

Tenth Day of October, 1989

*Attest:*

DONALD J. QUIGG

*Attesting Officer*

*Commissioner of Patents and Trademarks*